US011137167B2

(12) United States Patent
Zhou et al.

(10) Patent No.: US 11,137,167 B2
(45) Date of Patent: Oct. 5, 2021

(54) DEVICES TO CONVERT A CEILING/WALL REGISTER TO A MOTORIZED DAMPER

(71) Applicant: Innovative Building Energy Control, Lake Forest, CA (US)

(72) Inventors: Gangyi Zhou, Lake Forest, CA (US); Ruijun Tian, Lake Forest, CA (US)

(73) Assignee: Innovative Building Energy Control, Lake Forest, CA (US)

( * ) Notice: Subject to any disclaimer, the term of this patent is extended or adjusted under 35 U.S.C. 154(b) by 0 days.

(21) Appl. No.: 15/938,346

(22) Filed: Mar. 28, 2018

(65) Prior Publication Data

US 2019/0128559 A1 May 2, 2019

Related U.S. Application Data

(60) Provisional application No. 62/580,736, filed on Nov. 2, 2017.

(51) Int. Cl.
*F24F 13/14* (2006.01)
*F24F 13/15* (2006.01)

(52) U.S. Cl.
CPC ..... *F24F 13/1426* (2013.01); *F24F 13/15* (2013.01); *F24F 2013/1433* (2013.01); *F24F 2013/1446* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,348,078 | A * | 9/1994 | Dushane | F24F 3/044 165/209 |
| 6,338,677 | B1 * | 1/2002 | White | F24F 11/0001 454/335 |
| 6,692,349 | B1 | 2/2004 | Brinkerhoff et al. | |
| 7,130,720 | B2 | 10/2006 | Fisher | |
| 7,178,291 | B2 * | 2/2007 | Vasquez | E06B 7/096 49/74.1 |
| 7,399,222 | B2 * | 7/2008 | Moon | F24F 1/0011 454/277 |
| 7,832,465 | B2 | 11/2010 | Zou et al. | |
| 8,020,777 | B2 | 9/2011 | Kates et al. | |
| 8,142,265 | B2 * | 3/2012 | Carter | F24F 13/12 454/290 |
| 9,322,569 | B2 * | 4/2016 | Scharf | F24F 11/76 |
| 9,874,370 | B2 | 1/2018 | Uselton | |
| 2011/0198404 | A1 * | 8/2011 | Dropmann | F24F 13/082 236/49.3 |

(Continued)

*Primary Examiner* — Steven B McAllister
*Assistant Examiner* — Elizabeth M. May
(74) *Attorney, Agent, or Firm* — Stetina, Brunda, Garred and Brucker

(57) ABSTRACT

Devices for retrofitting existing, manual airflow registers are described that convert a manual register with blades into a motorized damper. The devices include a support structure attached to the register and having a motor that moves a linking apparatus. The linking apparatus is coupled with a lever of the register that itself is coupled with the blades such that movement of the lever rotates the blades and therefore control the amount of airflow through the register. By moving the linking apparatus via a motor, the lever can also be moved allowing the manual airflow register to be automatically controlled with the need to replace the existing register.

7 Claims, 5 Drawing Sheets

(56) References Cited

U.S. PATENT DOCUMENTS

| | | | |
|---|---|---|---|
| 2016/0091220 | A1 | 3/2016 | Kates |
| 2016/0123608 | A9 | 5/2016 | Karamanos et al. |
| 2016/0245535 | A1* | 8/2016 | Simpson ..... F24F 11/0001 |
| 2017/0291469 | A1 | 10/2017 | Romero Regalado et al. |

* cited by examiner

DEVICES TO CONVERT A CEILING/WALL REGISTER TO A MOTORIZED DAMPER

This application claims priority to U.S. provisional application Ser. No. 62/580,736 filed on Nov. 2, 2017. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of this invention is motorized damper technology.

BACKGROUND

HVAC (heating, ventilating, and air conditioning) zoning systems (also referred to as "zoned HVAC") are heating and cooling systems that use dampers in the ductwork to regulate and redirect air to specific areas of a space. Such systems permit the creation of customized temperature zones throughout the space for increased comfort and efficiency. Therefore, energy can be saved by not overcooling or overheating some areas.

Some prior art systems include those described in U.S. patent application Ser. No. 15/791,336, filed on Oct. 23, 2017, and U.S. provisional appl. No. 62/532,907, filed on Jul. 14, 2017. One of the key components of a HVAC zoning system is the use of a motorized damper in the ductwork. A damper is an airflow valve that is equipped with one or more blades, which can be opened or closed. If the one or more blades are driven by motor, it is called a motorized damper. With the motorized damper and central controller, air flow to a space can be controlled electronically.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In general, there are three types of motorized zoning dampers: inline dampers, slot-in dampers, and on-diffuser dampers. The inline damper comprises a part of the duct work, and is installed next to a branch take off. An exemplary inline damper is shown in FIG. 1. It has a motor 102 outside of the duct, which drives a blade 104 within the duct. The inline damper has two configurations: (a) motor close and spring return and (b) motor close and motor open.

An example of a slot-in damper is shown in FIG. 2. The slot-in damper is normally a rectangular piece inserted at a rectangular duct. It has blades 204 that open and close via a motor 202 to control the air flow.

The on-diffuser damper is normally for residential applications, an example of which is shown in FIGS. 3A-3D. The on-diffuser damper comprises one or more blades 304 controlled by a motor 302, and is disposed within the duct. It is typically installed in the can (see FIG. 3C) behind the stamped grill 310.

For residential and light commercial applications, inline dampers and slot-in dampers are generally not practicable due to construction cost consideration. The on-diffuser damper can be costly as well and must be built to match the can size. In addition, stamped grills are needed to cover the dampers which add additional cost.

In general, residential buildings use manually-adjustable ceiling/wall diffusers. This type of diffusers allows a home owner to manually adjust the air flow, and in some cases its direction, through the diffuser (either shutdown or open). FIGS. 4A-4C illustrates an exemplary diffuser, which comprises a stamped grille 410, movable blades 402 behind, and a manual lever 412 to rotate the blades 402. The diffuser can have different dimensions depending on the maximum air flow, such as 12"×6", 10"×6"12"×12". However, such diffusers must be manually controlled room-by-room, and are often in locations requiring a stepstool or other means to reach them.

Thus, there is still a need for a device that can utilize existing manually-adjustable diffusers to convert the manually adjustable diffusers to function as motorized dampers without tremendous cost.

SUMMARY OF THE INVENTION

The inventive subject matter provides apparatus, systems and methods of a device that can be used with existing diffusers at ceiling/wall registers to provide the functionality of a traditional motorized damper without the cost and complexity of a new system. This add-on or retrofit device can thereby convert existing manually-adjustable ceiling/wall registers, which may already be installed, to motorized dampers, which provides an economical HVAC zoning system thereby reducing energy costs. Because the device utilizes existing infrastructure, the HVAC zoning system can be affordable while providing useful functionality not otherwise possible. Therefore, homeowners will save energy on air conditioning and heating costs while providing for increased comfort.

Contemplated devices comprise a motorized controller that is configured to be installed on a HVAC zoning diffuser at an outlet of an air supply duct. The motorized add-on controller can be controlled by a centralized controller which can either be a digital computer system or be an analog system composed by many relays. The centralized controller has built-in logic, which switches the diffuser's blades to any angles for a specified air flow rate. The device can be communicatively coupled with the controller via a wired or wireless connection. It is contemplated that the device and its control is entirely separated from the HVAC system itself and can be used in conjunction with it.

Various objects, features, aspects and advantages of the inventive subject matter will become more apparent from the following detailed description of preferred embodiments, along with the accompanying drawing figures in which like numerals represent like components.

DESCRIPTION OF THE INVENTION

Throughout the following discussion, references may be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 5A:
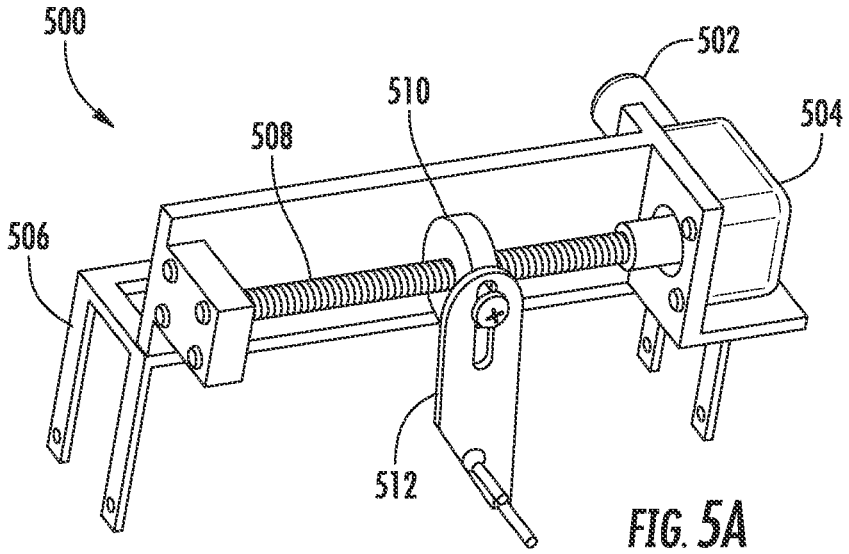
FIGS. 5A-5B illustrate a schematic of one embodiment of an add-on motorized damper/controller installed on the manual-controlling HVAC zoning diffuser.
Figure 5B:
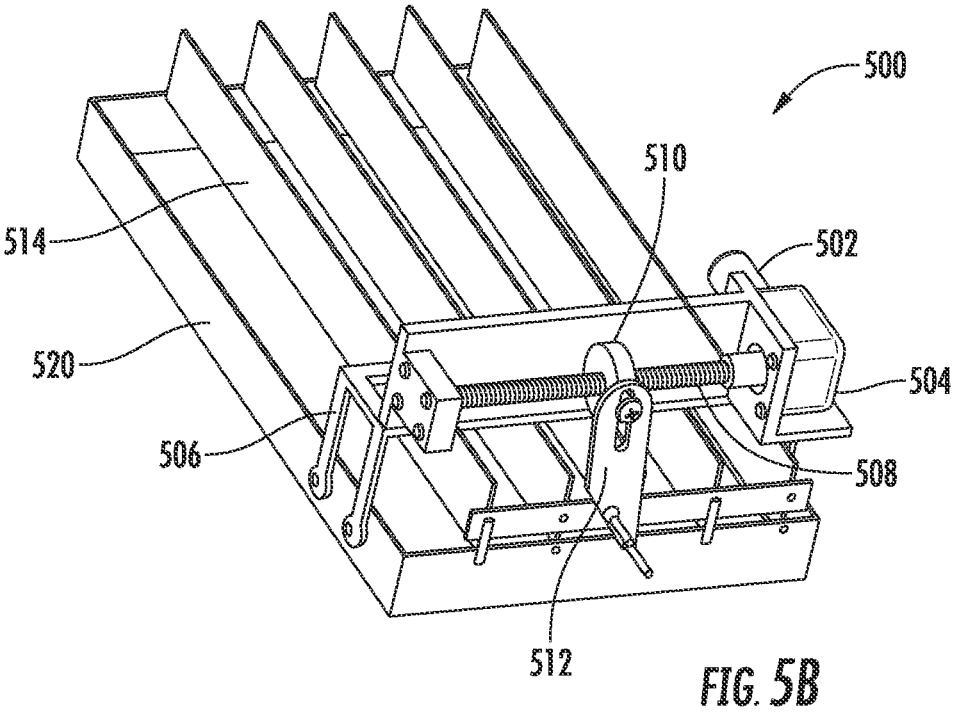

FIG. 5A shows an embodiment of an add-on motorized controller device with open sections to show its hardware components. FIG. 5B illustrates an exemplary embodiment of the use and installation of the add-on device of FIG. 5A with an existing manual-controlling zoning diffuser to allow the diffuser to be controlled automatically to any open angle between 0 and the maximum designed value.

As shown in FIGS. 5A-5B, the device 500 can include an electric, preferably DC, motor 502 and speed-adjusting gear box 504 that is attached to a metal frame 506 via first and second sets of legs, where the first set of legs attach to a first side of the diffuser and the second set of legs attach to a second side of the diffuser. The motor 502 and speed-adjusting gear box 504 compose the power of the add-on device 500. A threaded rod 508 can be connected to the driving power via a shaft adapter. The driving power rotates the threaded rod 508 clockwise or counterclockwise, depending on the signal from a centralized controller, to drive a linking disk 510 back and forth. The linking disk 510 can be coupled with a lever 512, which itself is coupled to the blades 514. Thus, movement of the linking disk 510 along the rod 508 will cause movement of the lever 512, and thereby rotate the blades 514

The linking disk 510 connects the threaded rod 508 and the manual lever 512. The linking disk 510 is driven back and forth by the threaded rod 508, thus, moving or rotating the lever 512 clockwise/counterclockwise. The lever 512 connects the diffuser 520 and movable blades 514. During rotation/movement of the lever 512, the blades 514 are rotated to different open angles. In this way, the circular rotating motion of the threaded rod 508 is transformed into linear motion for the linking disk 510 disposed along the threaded rod 508. Thus, the continuous rotation of the lever 512 can move the blades 514 to any desired angle between zero degrees and the designed maximum value of the diffuser 520 upon receipt of a signal from a centralized controller. In some embodiments, two end-stop sensors could be installed on opposing sides of the frame 506 to mark the limitation of the minimum and maximum displacement of the linking disk 510.

As shown in FIG. 5B, device 500 can be connected to an existing diffuser 520 using the frame 506 of the device 500, with the first set of legs being attached to the first side of the diffuser 520 and the second set of legs being attached to the second side of the diffuser 520. The frame 506 can be securely fastened to the diffuser 520 by screws, although any commercially suitable fastener(s) could be used including, for example, bolts, magnets, snaps, welds, and so forth. Preferably, device 500 is attached on a side or inside surface of the diffuser 520 (e.g., within the outlet when installed), but could alternatively be attached to an outside surface of the diffuser and work to operate the lever 512 extending from that surface.

Figure 1:
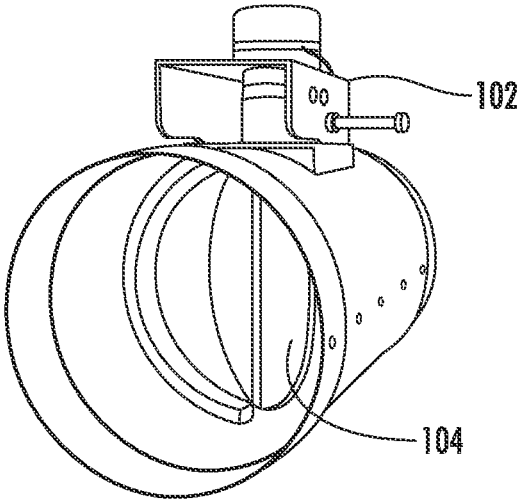
FIG. 1 (PRIOR ART)
FIG. 1 illustrates one embodiment of an inline damper.
Figure 2:
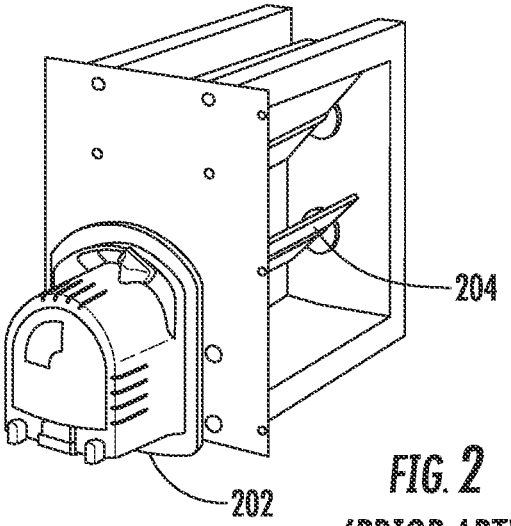
FIG. 2 (PRIOR ART)
FIG. 2 illustrates one embodiment of a slot-in damper.
Figure 3A:
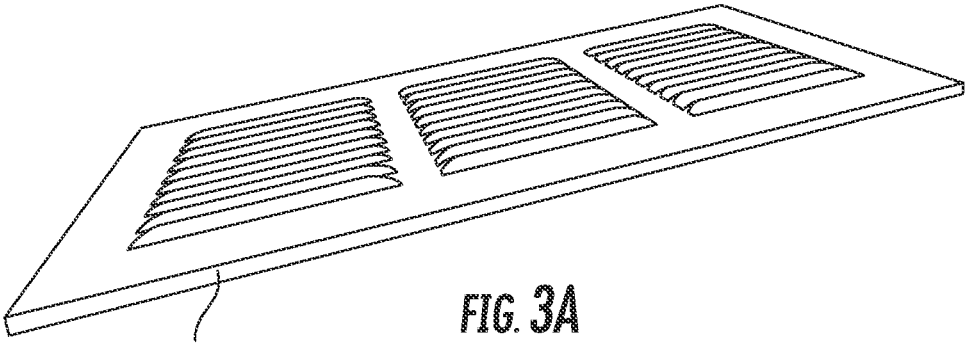
FIG. 3A (PRIOR ART)
FIGS. 3A-3D illustrate components of one embodiment of an on-diffuser damper.
Figure 3B:
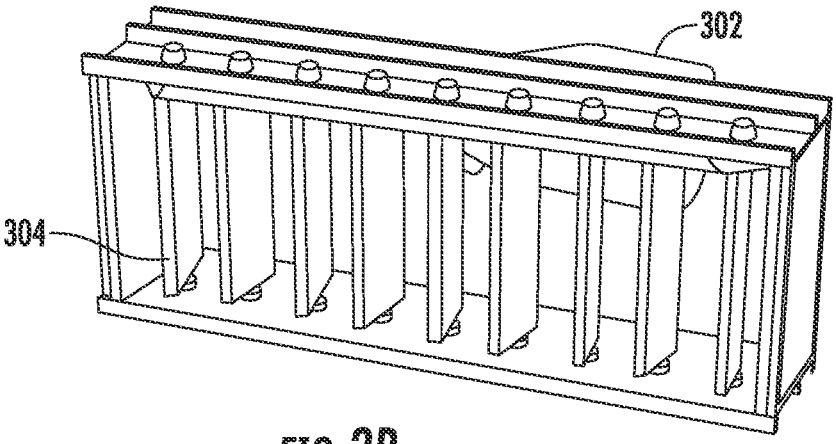
FIG. 3B (PRIOR ART)
Figure 3C:
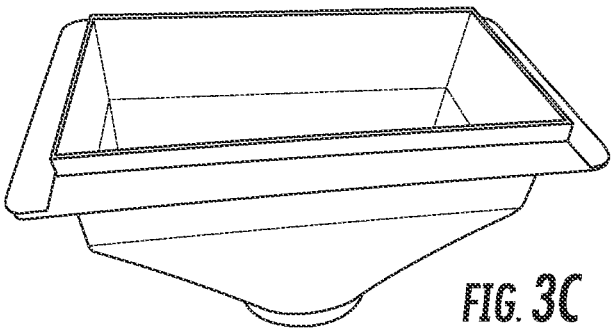
FIG. 3C (PRIOR ART)
Figure 3D:
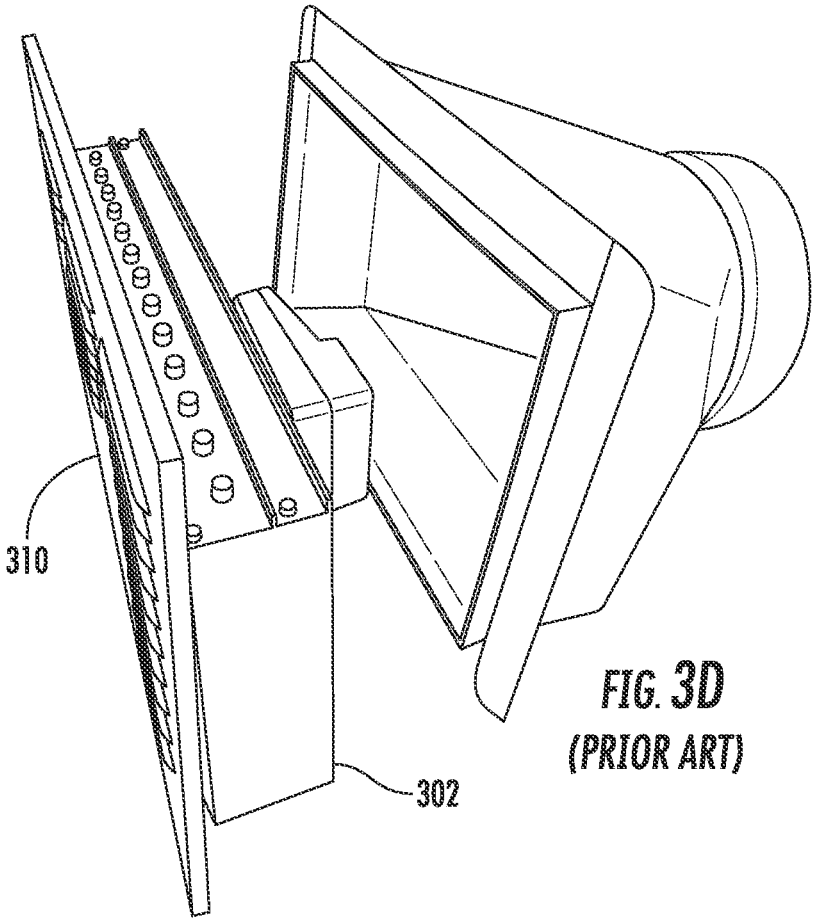
FIG. 3D (PRIOR ART)
Figure 4A:
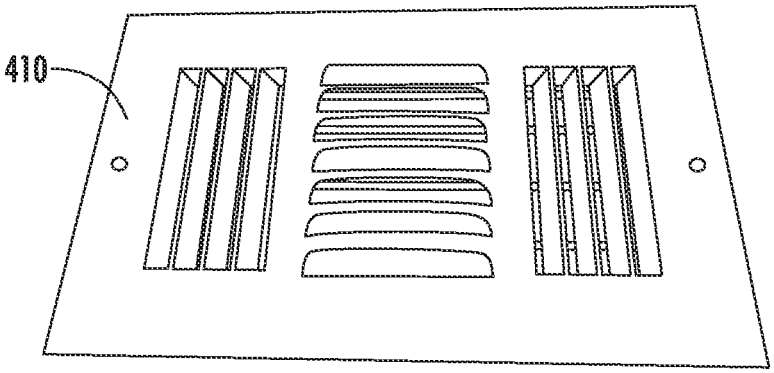
FIG. 4A (PRIOR ART)
FIGS. 4A-4C illustrate various views of one embodiment of a diffuser with manually movable blades.
Figure 4B:
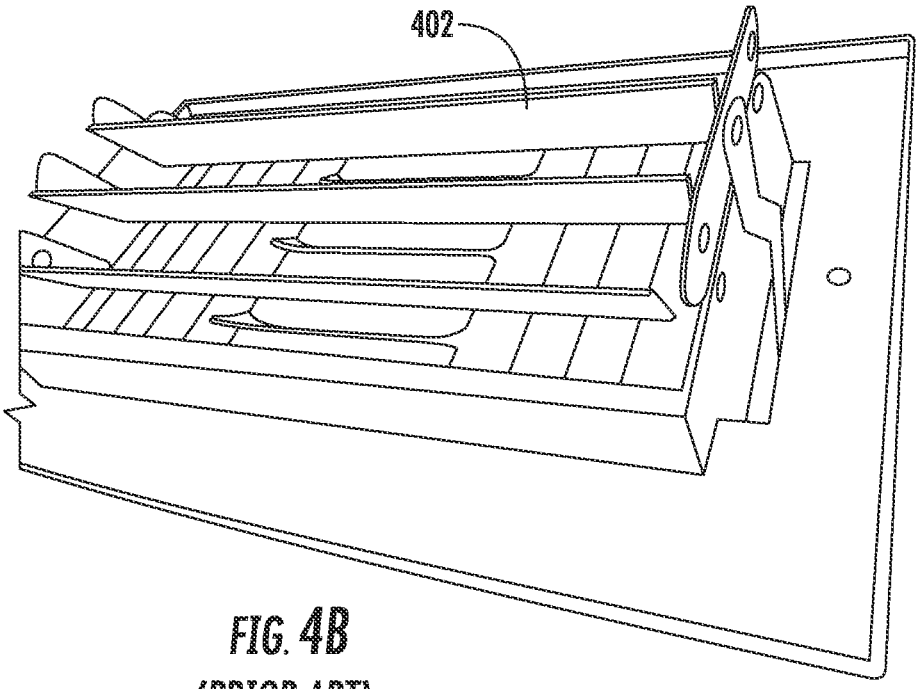
FIG. 4B (PRIOR ART)
Figure 4C:
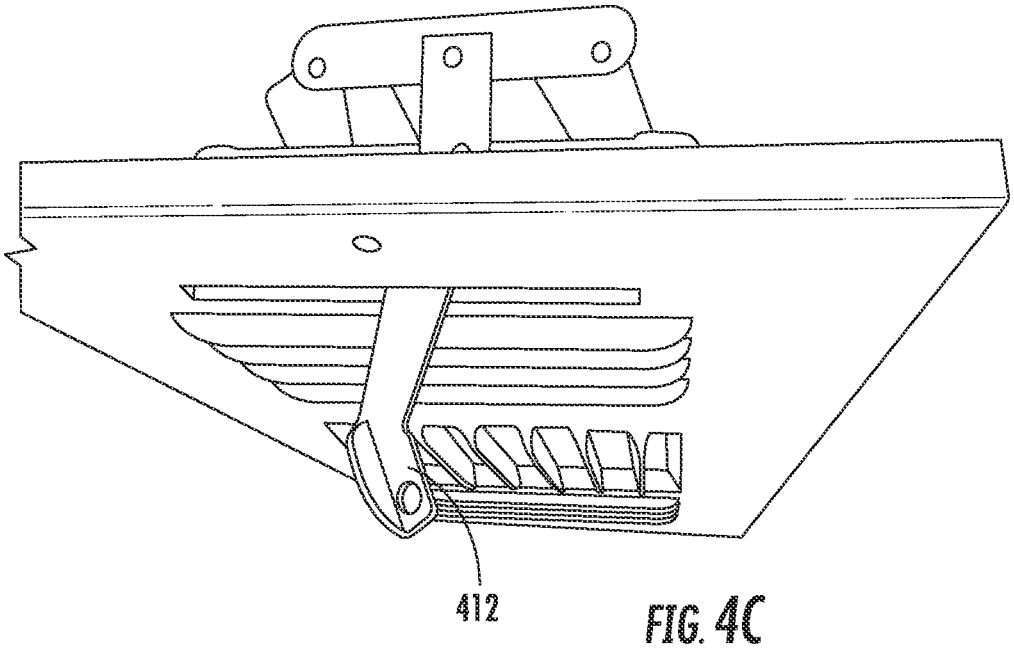
FIG. 4C (PRIOR ART)

In the simple sketch of FIG. 5B, the grill of the diffuser 520 and the blades 514 are components of the original existing diffuser 520 to be retrofitted (refer to FIG. 4 for details). The blades 514 can be rotated to a widely open angle for a large air flow rate. There is no change required to adapt the existing diffuser; rather, the add-on controller device 500 allows for motorized operation of the diffuser 520.

It is contemplated that the device 500 could receive power via an internal battery and/or line voltage.

It is further contemplated that the device 500 could communicate with a remote controller via a wired or wireless connection. Such communication could include a status of the diffuser (e.g., open or shut), as well as commands to the motor to open or shut the blades 514. The controller could open or shut the blades 514 as a function of a sensed condition in one or more areas of a building (e.g., occupancy, temperature, humidity, smoke, etc.), a pressure within the duct, time of day, and/or predefined settings.

Although less preferred, it is contemplated that the threaded rod could be replaced with an actuator that causes movement of the linking apparatus in a single direction. In such embodiments, the spring or other component could be used to store potential energy, and cause the lever to move in an opposite direction when a force ceases to be applied to the lever. Such embodiments could utilize a rod or string that is coupled to the lever and causes the lever to move when the rod is moved or when the string is wound about a spool.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method for retrofitting an existing manual airflow register to a motorized damper, wherein the register comprises a plurality of blades and a lever operatively connected to the blades such that movement of the lever rotates each of the blades simultaneously, the method comprising:

attaching a retrofitting device to the existing manual airflow register, the retrofitting device comprising:

a support structure including a frame having first and second sets of legs extending outwardly from opposing sides of the frame, wherein the first set of legs are configured to attach to a first side of the existing manual airflow register and the second set of legs are configured to attach to a second side of the existing manual airflow register, wherein the first and second sides of the existing manual airflow register are a first pair of opposed sides, the support structure being sized and configured to be spaced from a second pair of opposing sides of the existing manual airflow register when the first and second sets of legs are connected to the first and second sides of the existing manual airflow register;

a gear box disposed on the support structure;

a threaded rod and a motor, the gear box connecting the threaded rod to the motor such that the motor can cause rotation of the threaded rod via the gear box, wherein the threaded rod and motor are supported by the support structure such that the threaded rod includes a first end portion coupled to the motor and an opposing second end portion rotatably coupled to the support structure; and a linking apparatus on the threaded rod, such that rotation of the threaded rod causes movement of the linking apparatus with respect to the support structure;

the retrofitting device being attached to the existing manual airflow register by attaching the first set of legs to the first side of the existing manual airflow register, and attaching the second set of legs to the second side of the existing manual airflow register, where the first side is opposite of the second side; and coupling the linking apparatus to the lever of the existing manual airflow register using a pin that extends from the linking apparatus to a hole in the lever, such that the movement of the linking apparatus causes movement of the lever, which causes each of the blades to rotate simultaneously.

2. The method of claim 1, wherein the linking apparatus comprises a disc that fits about the threaded rod.

3. The method of claim 1, further comprising communicatively coupling a controller with the motor, wherein the controller is configured to send a signal to the motor to cause the motor to move the linking apparatus via the threaded rod and gear box.

4. The method of claim 3, wherein the controller and motor are coupled via a wired connection.

5. The method of claim 3, wherein the controller and motor are wirelessly connected.

6. The method of claim 1, wherein movement of the threaded rod causes the plurality of blades to close.

7. The method of claim 1, wherein movement of the threaded rod causes the plurality of blades to open.

* * * * *